US005160141A

United States Patent [19]

Crews

[11] Patent Number: 5,160,141

[45] Date of Patent: Nov. 3, 1992

[54] GOLF PUTTER

[76] Inventor: Debra J. Crews, 1005 Montpelier Dr., Greensboro, N.C. 27410

[21] Appl. No.: 852,051

[22] Filed: Mar. 16, 1992

Related U.S. Application Data

[63] Continuation of Ser. No. 673,795, Mar. 22, 1991, abandoned.

[51] Int. Cl.[5] ..... A63B 53/02

[52] U.S. Cl. ..... 273/164.1; 273/80 C; 273/80.2; 273/167 G; 273/164.2

[58] Field of Search ..... 273/167–175, 273/79, 78, 77 R, 164, 80.1, 80.2, 80 C; D21/217, 218, 219

[56] References Cited

U.S. PATENT DOCUMENTS

| | | | |
|---|---|---|---|
| D. 209,301 | 11/1967 | Comitz | 273/80 C X |
| D. 242,730 | 12/1976 | Pappas | 273/164 X |
| 1,250,296 | 12/1917 | Fitzjohn | 273/167 G X |
| 1,657,972 | 1/1928 | Rowe | 273/79 |
| 3,675,923 | 7/1972 | Allen et al. | 273/80.2 |
| 3,758,115 | 9/1973 | Hoglund | 273/164 |
| 3,989,257 | 11/1976 | Barr | 273/175 |
| 4,010,958 | 3/1977 | Long | 273/169 |
| 4,121,833 | 10/1978 | Prueter | 273/175 |
| 4,141,556 | 2/1979 | Paulin | 273/164 |
| 4,650,191 | 3/1987 | Mills | 273/164 |
| 4,722,528 | 2/1988 | Tsao | 273/164 |
| 4,815,739 | 3/1989 | Donica | 273/80 C |
| 4,871,174 | 10/1989 | Kobayashi | 273/164 |
| 4,921,253 | 5/1990 | Tesori | 273/167 B |
| 4,979,744 | 12/1990 | Alcala | 273/169 |

FOREIGN PATENT DOCUMENTS

| | | | |
|---|---|---|---|
| 837089 | 6/1960 | United Kingdom | 273/175 |

OTHER PUBLICATIONS

"Golf World" Magazine, Jan. 4, 1972 Issue, p. 36.
"The Golfworks" Magazine, 1990 issue, p. 12.
"Sports Illustrated" Magazine, Jul. 9, 1990 issue, pp. 40–63.
"USGA 1991 Rules of Golf", 1987 edition.

*Primary Examiner*—Vincent Millin
*Assistant Examiner*—Sebastiano Passaniti

[57] ABSTRACT

The invention herein provides a golf putter whereby the shaft is rearwardly disposed of the putter face by attachment of a neck which is centrally joined at the back of the club head. The shaft can be positioned at a variety of angles to a vertical line whereas the longitudinal axis of the shaft intersects an axis passing through the center of the face perpendicular thereto and spaced some distance rearwardly thereof.

14 Claims, 3 Drawing Sheets

GOLF PUTTER

This is a continuation of application Ser. No. 07/673,795 filed Mar. 22, 1991, now abandoned.

BACKGROUND OF THE INVENTION

1. Field Of The Invention

The present invention pertains to a golf club and particularly to a putter for more precise and accurate control of the putting stroke.

2. Description Of The Prior Art And Objectives Of The Invention

For years various shapes and designs of putters have been created in an effort to construct a club which will provide an advantage for golfers' "green" game. A myriad of different club faces, heads, shafts and grips have been devised over the years to furnish a solution to a most difficult and perplexing part of the game since putting s part mental, part physical, and part luck. Some putters which have been found to aid certain golfers, will not benefit all, from the beginner to the experienced professional. Thus, with the shortcomings and disadvantages of conventional putters known, the present invention was conceived and one of its objectives is to provide a putter which can be used by both amateur and professional golfers to increase their putting ability and reduce their scores.

It is another objective of the present invention to provide a putter with a shaft mounted rearwardly of the putter head and spaced therefrom by attachment to the distal end of a neck.

It is yet another objective of the present invention to provide a putter with a neck centered on the putting head at the intersection of the longitudinal center line or axis and the vertical center line of the putter face directly behind the "sweet-spot" of the putter head.

It is yet another objective of the present invention to provide a putter configuration which allows the golfer better vision, hence control during the putting stroke and consequently greater putting accuracy.

It is yet still another objective of the present invention to provide a putter configuration which allows the golfer to putt with the golfer's balance point centered over both feet in a more stable position and to keep the ball forward in the stance, a preferred ball position for many golfers.

Various other objectives and advantages of the present invention become apparent to those skilled in the art as a more detailed presentation is set forth below.

SUMMARY OF THE INVENTION

The aforesaid and other objectives are realized by a putter construction which is designed in accordance with the *USGA* 1991 *RULES OF GOLF* whereby the club shaft is attached to the putter head rearwardly thereof and spaced therefrom by an interposed neck. The putter head includes a face for striking the ball and the neck affixes to the rear of the putter head and extends perpendicularly to the vertical plane of the face, rearwardly from the putting head. A hosel is secured to the distal end of the neck for reception of the club shaft. The hosel is positioned to intersect the neck directly behind the center of the face of the putter and is so positioned whereby a line extending perpendicularly through the center of the putter face would intersect the longitudinal axis of the shaft behind the club head and directly behind the "sweet-spot" of the putter head. The hosel is joined at a variable angle of between 0° to 60° and the shaft is joined at a variable angle of between 10° to 60° when contrasted with the vertical axis (0°) of the putter face to provide increased vision for the golfer during stance alignment and swing and to provide for the club head to be placed flatly on the ground. The total length of the shaft can vary from between thirty to sixty inches.

DESCRIPTION OF THE PREFERRED EMBODIMENT

Figure 1:
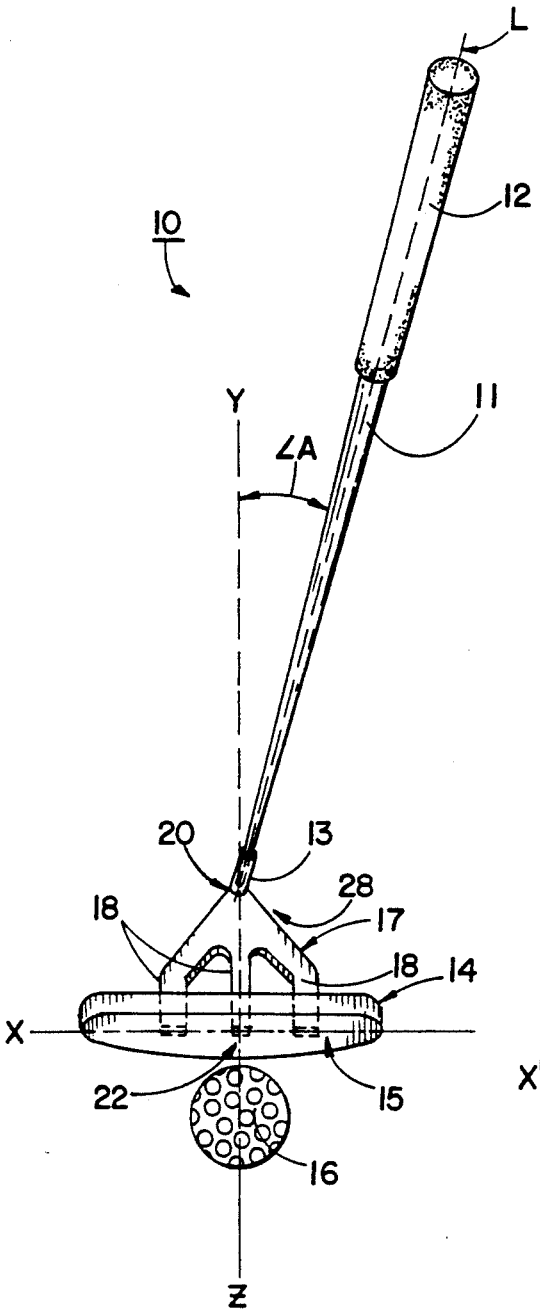
FIG. 1 demonstrates a putter of the invention in a front perspective view as in addressing a ball for putting.
Figure 1A:
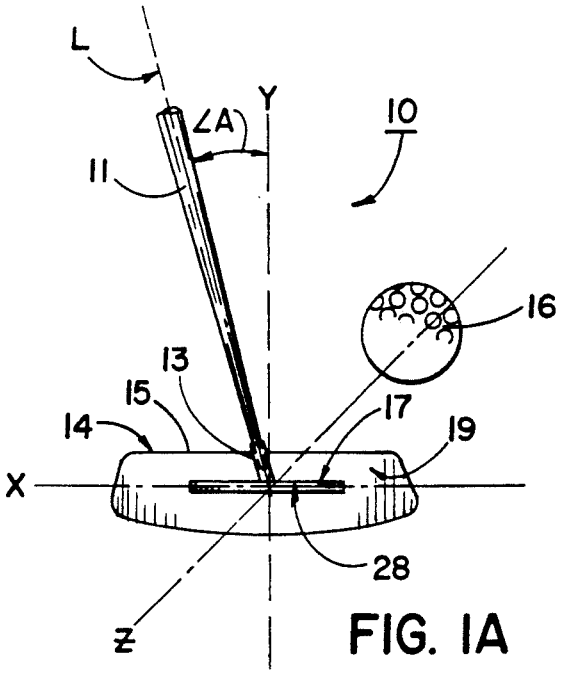
FIG. 1A shows a rear elevational view of the head portion of the putter as shown in FIG. 1.
Figure 1B:
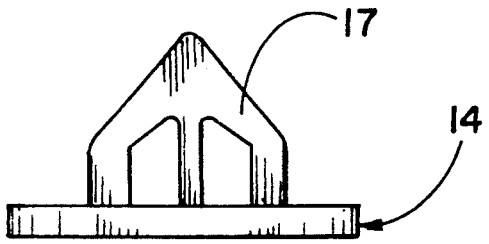
FIG. 1B shows a bottom plan view of the putter as seen in FIG. 1.

The preferred form of the invention is shown in FIGS. 1, 1A and 1B whereby a golf putter is constructed of cast aluminum for a "right handed" golfer whereby the head is joined to a trio of neck tines. The hosel and shaft of the putter engage and connect to the distal end of the neck to form a joint therewith which is rearward of the center of the club face. The shaft and hosel are positioned at an angle of approximately 70° to the vertical axis of the putter face and the neck is centered behind the putter face and extends approximately two to three inches rearwardly whereby the distal end of the neck unites with the hosel. The design results in a putter head which maintains an evenly balanced swing path perpendicular to the target line (imaginary straight line from the ball to the center of the hole) for a straight putt.

DETAILED DESCRIPTION OF THE DRAWINGS AND OPERATION OF THE INVENTION

For a better understanding of the golf club of the invention, turning now to the drawings, FIG. 1 illustrates "right-handed" putter 10 having a conventional shaft 11 having a rear surface, grip 12 and hosel 13 having a rear surface. Club head 14 may be formed of cast aluminum or the like and likewise is of conventional design having front face 15 for striking ball 16. Neck 17 comprises a trio of tines 18 which attach at the center of back 19 of head 14 as somewhat better shown in FIG. 1A. Hosel 13 and shaft 11 join at an angle "A" to axis "Y" as seen in FIG. 1A. "L" represents the longitudinal axis of shaft 11 and hosel 13. Angle A is approximately twenty degrees (20°) from the vertical, such as to the Y axis which represents a line perpendicular to the "X" axis or longitudinal, horizontal center axis of face 15 in FIGS. 1 and 1A. Angle A has been found to be suitable for a variety of golfers of average height, however depending on height and stance of a particular golfer, the angle A may vary in the range from ten to sixty degrees (10°-60°). Axis "Z" as shown in FIG. 1A is likewise perpendicular to axis X and axis Y. Axis Z represents a horizontal line running from the hosel/-neck joint 20 through the vertical center of Y at the X, Y and Z intersection on face 15. The X, Y and Z intersection is considered the center of "sweet-spot" area 22 on putter face 15 and for best ball control area 22 strikes the center of golf ball 16 during putting as shown in FIG. 1. Distal end 28 of neck 17 is attached to hosel 13, allowing shaft 11 to be fully rearward of club head 14. As would be understood by those skilled in the art, a "left-handed" putter could likewise be made employing similar techniques.

Figure 4A:
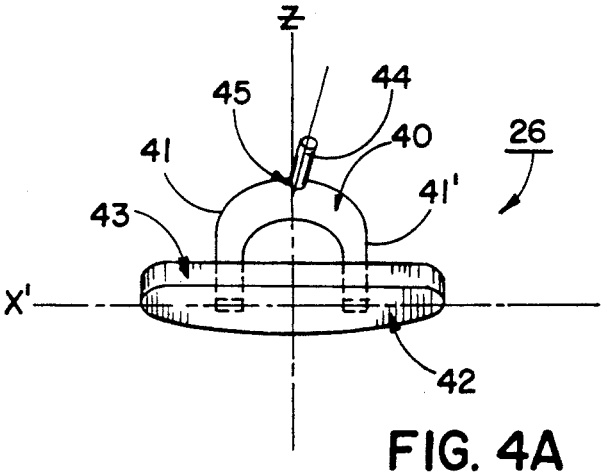
FIGS. 4A–4B depicts yet another embodiment of the putter of the present invention.
Figure 4B:
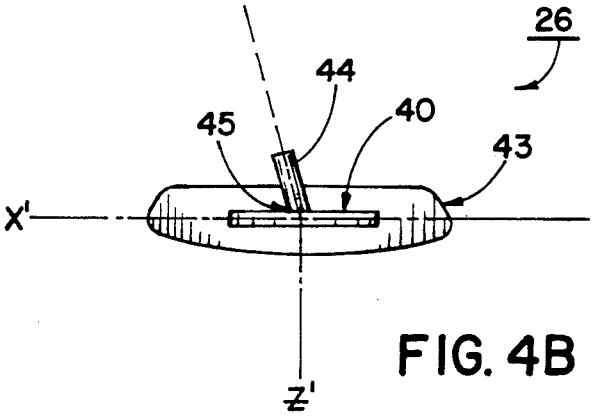
Figure 3A:
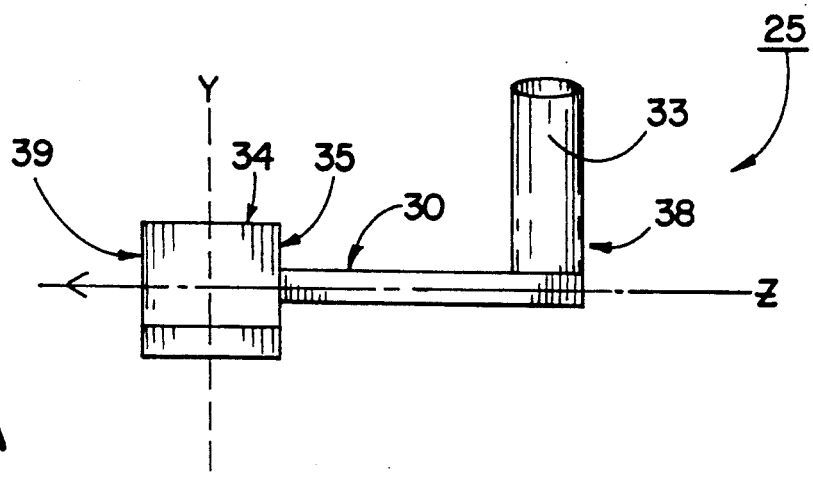
FIGS. 3A–3C illustrates another embodiment of the putter with various neck lengths.
Figure 3B:
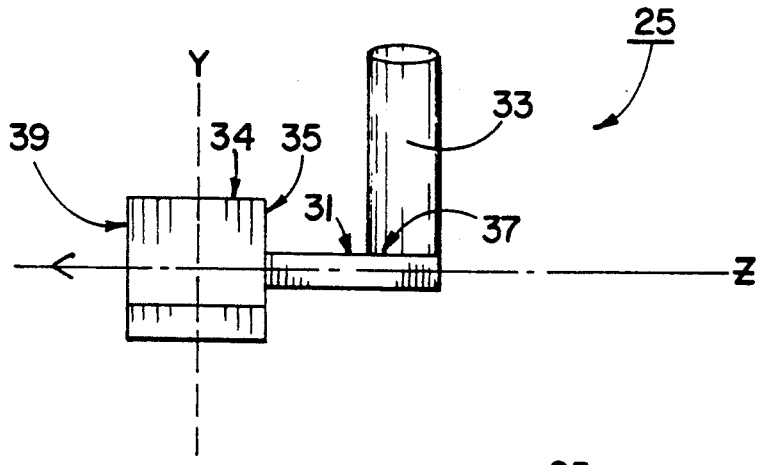
Figure 3C:
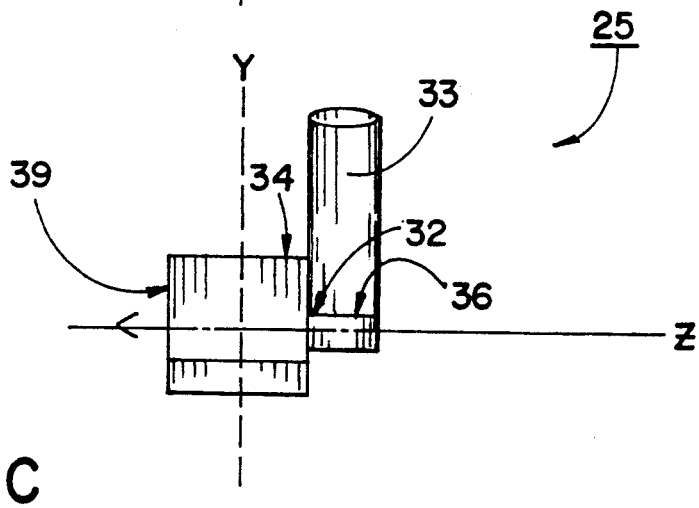

While neck 17 in FIGS. 1 and 1A comprises a three tine design, neck 40 in FIGS. 4A and 4B represent a two tine neck design and in FIGS. 3A-3C, necks 30 and 31 represent a single tine neck with neck 32 having less than one-eighth in length.

As discussed regarding FIGS. 1 and 1A, the longitudinal axis L of shaft 11 extends at an angle A approximately twenty degrees (20°) from the direction of axis Y. The shaft 11 and hosel 13, by connecting to the distal end 28 of neck 17, are spaced rearwardly from head 14 as shown in FIGS. 1 and 1A a distance of approximately three inches. This spacing provides a better view by the golfer of club head 14 as it strikes ball 16 and therefore increases putting accuracy due to the improved vision.

Figure 1C:
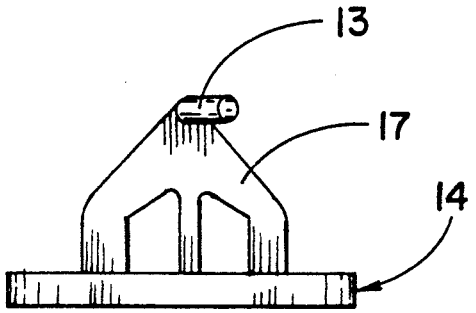
FIG. 1C shows a top plan view of the putter as seen in FIG. 1.

FIGS. 1B and 1C illustrate the embodiment of the invention in FIG. 1 seen respectively in bottom and top plan views to demonstrate the shaft alignment with putter head 14.

Figure 2:
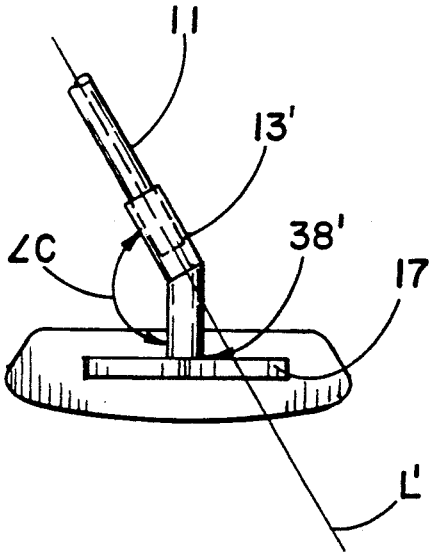
FIG. 2 pictures a rear view of another embodiment having a hosel joined to the shaft at an angle C, between 10° to 60°, and joined to the putter head at a vertical angle of 0°.

Another embodiment of the invention is seen in FIG. 2 whereby hosel 13' is provided with a crook or bend with an angle "c" of between 10 to 60 degrees, to provide the same disposition of shaft 11 to neck 17 as shown in FIG. 1. Thus, hosel 13' is perpendicularly mounted on neck 17 at joint 38' but allowing the longitudinal axis L' of shaft 11 to be angularly postioned relative to neck 17.

In FIG. 3A, a second embodiment, putter 25 is shown with hosel 33 which unites with single neck 30 at joint 38, some three inches from putter face 39. In FIG. 3B single neck 31 joins hosel 33 a distance of approximately two inches from face 39, and in FIG. 3C, club face 39 is spaced approximately one inch from joint 36. As further shown in FIGS. 3A-C, single necks 30-32 attach to the back 35 of putter head 34, approximately at the vertical center of face 39. Also, as seen in FIGS. 3A-C, single necks 30, 31 and 32 respectively join putter head 34 at the horizontal center thereof with the joints 36, 37 and 38 positioned along axis Z.

In FIGS. 4A and 4B, a third embodiment, putter 26 provides neck 40 having a pair of tines 41, 41' which are equally spaced on each side of center horizontal axis Z' of face 42 on head 43 as clearly shown in FIG. 4A. Also, in FIGS. 4A and 4B, hosel 44 is positioned at an angle zero to sixty degrees (0°-60°) from a vertical axis Z. Neck 40 is centered rearwardly of face 42 and provides a joint 45 directly behind the center line on the Z' axis which passes through face 42.

The embodiment of the invention as seen in FIGS. 1 and 1A was examined for accuracy and putting quality by twenty(20) test subjects who each agreed to putt twenty (20) balls with three (3) different putters (a total of sixty putts for each subject). The subjects each brought their own putters for one (1) set (20 balls). The putter of the invention was used for another twenty (20) balls, and each used a conventional putter having a shaft offset forward, toward the putter blade with twenty (20) balls. The order of the three (3) putter used was varied across the test subjects. The range of golfing ability of the subjects varied from beginners to professionals.

the results showed that the subjects made five percent (5%) more putts using the putter of the invention as compared to their won putters and to the conventional forward offset putter. The putter of the invention showed thirteen percent (13%) greater accuracy of alignment at address compared with their own putter and the offset putter. The putter design of the invention showed a six percent (6%) greater accuracy when compared to their own putters and an eight percent (8%) greater accuracy than the convention offset putter at impact. Confidence, attention focus, and quality of the putt were slightly (1%) higher for the putter of the invention as compared with eight of the other two (2) conventional putters used.

Therefore, a golfer by using the invention herein is equipped with a putter which allows more direct force from the swing to be transferred to the sweet-spot on the club face, hence a better "feel" as the club strikes the ball. Also, by spacing the shaft/hosel at the rear center line of the face, better club and ball vision is maintained throughout the putting stroke for greater putting accuracy and lower scores. Lastly, the invention allows the golfer to putt with the shaft and the golfer's center of balance to be in the center of the stance, a more stable position, yet allowing the golfer to keep the ball forward in the stance, a generally preferred ball position.

The illustrations and examples provided herein are for explanatory purposes and show a right-hand club. A similar left-hand club can also be manufactured utilizing the same concepts, techniques and dimensions but making the necessary "left-hand" modifications as conventionally employed in golf club construction. These examples and are not intended to limit the scope of the appended claims.

I claim:

1. A golf putter having a linear shaft, having a rear surface a head, said head having a planar face, a linear neck, said neck separating said shaft from said head, said shaft and said neck uniting to form a joint, the improvement comprising: said neck comprising a plurality of tines, said tines extending rearwardly of said planar face, said linear shaft being rigidly united to said neck at said joint rearwardly of said head, said joint being centered at the intersection of the longitudinal and vertical axes of said face with the rear surface of said shaft proximate said joint defining an extreme rear of said putter whereby the golfers view of said putter head with the putting target during address of the ball is improved to increase putting accuracy.

2. The golf putter of claim 1 wherein said joint is formed parallel to the vertical center of said face.

3. The golf putter of claim 1 wherein the longitudinal axis of said shaft and the longitudinal axis of said face interest at an angle of approximately 10° to 60° to the vertical axis.

4. The golf putter of claim 1 wherein the longitudinal axis of said shaft and the vertical axis of said face intersect at an angle of approximately 20°.

5. The golf putter of claim 1 wherein said shaft is spaced rearwardly of said face approximately one to three inches.

6. The golf putter of claim 1 wherein said shaft is spaced rearwardly of said face three or more inches.

7. The golf putter of claim 1 wherein said shaft is spaced rearwardly of said face less than three inches.

8. The golf putter of claim 1 and including a hosel, said hosel attached to said shaft, said hosel attached to said neck, said neck attached to said head at the center of the longitudinal axis of said face, said shaft spaced rearwardly of said head.

9. The golf putter of claim 8 wherein said neck is attached to said head at the vertical center of said face.

10. The golf putter of claim 8 wherein said neck comprises a trio of tines.

11. The golf putter of claim 8 wherein said neck comprises a pair of tines.

12. A golf putter having a linear shaft, a head, a hosel, having a rear surface said hosel joined to said shaft, a linear neck, said neck separating said head from said hosel, said neck rigidly joined to said hosel and to said head, said head having a planar face for striking a golf ball, said face positioned forward of said shaft, the improvement comprising:

said neck extending perpendicularly rearwardly of said head and having a plurality of tines, said tines connected to said head behind said face, said neck joined to said hosel at the intersection of the longitudinal and vertical axes of said face, said shaft joined to said hosel, and said hosel joined to said neck at an extreme rearward position of said neck, the rear surface of said hosel proximate said neck defining an extreme rear of said putter whereby the golfer's view of said putter head with the putting target during the address of the ball is improved to increase putting accuracy.

13. The golf putter of claim 12 wherein said shaft is spaced rearwardly approximately one to three inches from said face.

14. The golf putter of claim 12 wherein said shaft is spaced rearwardly more than one-half from said face.

* * * * *